US005697120A

United States Patent [19]

Robinson

[11] Patent Number: 5,697,120

[45] Date of Patent: Dec. 16, 1997

[54] WET/DRY CLEANER

[75] Inventor: Leonard Robinson, Skipton, United Kingdom

[73] Assignee: Goblin Limited, Normanton, England

[21] Appl. No.: 493,683

[22] Filed: Jun. 22, 1995

[30] Foreign Application Priority Data

Jun. 22, 1994 [GB] United Kingdom ..... 9412512

[51] Int. Cl.[6] ..... A47L 13/26

[52] U.S. Cl. ..... 15/321; 222/509; 222/518; 251/244; 251/321; 251/325

[58] Field of Search ..... 15/321, 322; 222/340, 222/505, 509, 518; 251/321, 322, 244, 245, 325, 334, 344, 354, 351, 349

[56] References Cited

U.S. PATENT DOCUMENTS 4,260,130 4/1981 Brehm ..... 251/113
4,381,099 4/1983 Knedlik ..... 251/14

FOREIGN PATENT DOCUMENTS 935059 8/1963 United Kingdom .
1081554 8/1967 United Kingdom .
1141444 1/1969 United Kingdom .
2002326 2/1979 United Kingdom .

OTHER PUBLICATIONS

Search Report dated Sep. 19, 1994 with respect to UK Application No. 9412512.7 filed Jun. 22, 1994.

*Primary Examiner*—David Scherbel
*Assistant Examiner*—Terrence Till
*Attorney, Agent, or Firm*—Marshall, O'Toole, Gerstein, Murray & Borun

[57] ABSTRACT

A suction tube assembly for a wet/dry cleaner comprising a suction tube (60), a shampoo delivery conduit (44,45) extending along the suction tube, a valve forming a part of the conduit and operating means (50) for the user to operate the valve whilst manipulating the suction tube, the valve comprising a valve body (18) having a tubular portion within which is located a generally tubular portion of a valve piston (38), said tubular valve piston portion having a bore in its wall to provide communication between the interior and exterior of the tubular piston portion, means (37) biasing the piston towards a position in which sealing means (32,34) between the piston and the body prevent flow of fluid beyond said piston, said piston being movable axially by the operating means against said biasing means to release said sealing means and thereby allow fluid flow.

25 Claims, 4 Drawing Sheets

WET/DRY CLEANER

This invention relates to a suction tube assembly for a wet/dry cleaner and to a cleaner provided with such an assembly.

In wet/dry cleaners a conduit for shampoo is carried alongside the suction tube. Flow of shampoo along the conduit is usually controlled by means of a valve which can be operated by a person using the cleaner in order to allow shampoo to be fed to the item being cleaned. There is a need for a reliable, relatively simple and Inexpensive valve and operating mechanism for such an application. The present invention is directed to meeting this need.

According to the present invention there is provided a suction tube assembly for a wet/dry cleaner comprising a suction tube, a shampoo delivery conduit extending along the suction tube, a valve forming part of the conduit and operating means for the user to operate the valve whilst manipulating the suction tube, the valve comprising a valve body having a tubular portion within which is located a generally tubular portion of a valve piston, said tubular valve piston portion having a bore in its wall to provide communication between the interior and exterior of the tubular piston portion, and means biasing the piston towards a position in which sealing means between the piston and the body prevent flow of fluid beyond said piston, said piston being movable axially by the operating means against said biasing means to release said sealing means and thereby allow fluid flow.

The biasing means may comprise a spring. The tubular valve piston portion may have two diametrically opposed bores. The sealing means may comprise two axially spaced O-rings, one located in a groove in the exterior of the tubular piston portion and the other being disposed between a shoulder at the end of the tubular body portion and the end of the piston.

In another aspect the invention provides a suction tube assembly for a wet/dry vacuum cleaner comprising a suction tube, a shampoo delivery conduit extending alongside the tube, an in-line valve disposed in the conduit, the valve having a body portion and a piston movable axially thereof to effect opening of the valve, means locating the body portion relative to the suction pipe and valve operating means for axially moving the piston, the valve operating means being supported from the suction tube for the user to operate the valve whilst manipulating the suction tube.

The piston may be movable axially within the tubular body portion by operating of a lever which engages projections on said piston.

The lever may comprise a bifurcated portion which straddles the valve body. The lever may be pivotable relative to the suction tube.

Thus, there may be a housing attached to the suction tube and encasing the valve and the lever, the valve body being located in the housing and the lever being pivotally mounted therein.

The housing may be fitted beneath a curved handle portion of the suction tube.

The invention will be described now by way of example only, with particular reference,to the accompanying drawings. In the drawings.

Figure 1:
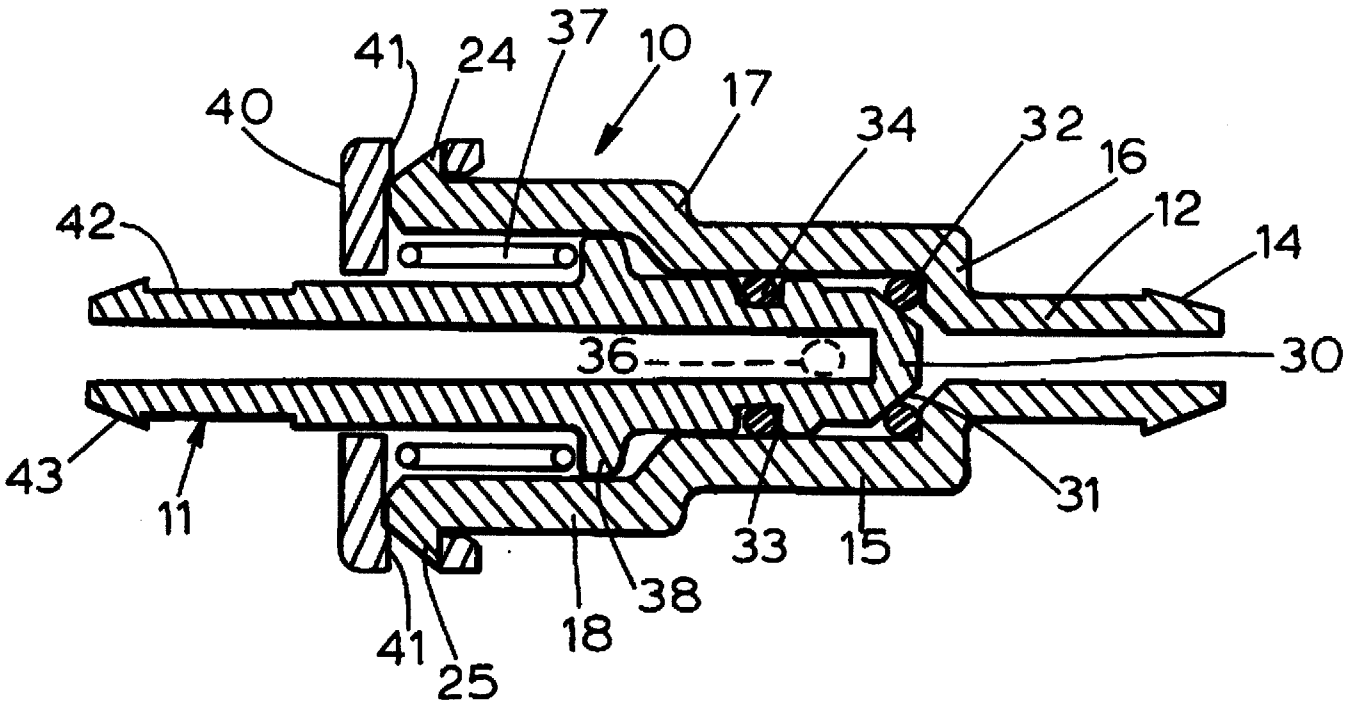
FIG. 1 is a cross-sectional view of a valve forming part of an assembly in accordance with the present invention.

Referring to FIG. 1 of the drawings the valve has a body (10) and a piston (11 ). The body (10) has a first tubular portion (12) with a frustoconical end (14) which can receive the end of a conduit which carries shampoo. The first tubular portion (12) is formed integrally with a second larger diameter tubular portion (15) which extends axially therefrom, a shoulder (16) being formed therebetween. The second tubular portion (15) is formed integrally with an axially extending third tubular portion (18), a shoulder (17) being farmed between the second and third portions. The second tubular portion (15) has an outwardly extending circumferential flange (20) (see FIG. 2) which, in sue, acts to secure the valve body. The plane of the flange (20) is inclined relative to a radial section through the body (10).

Figure 2:
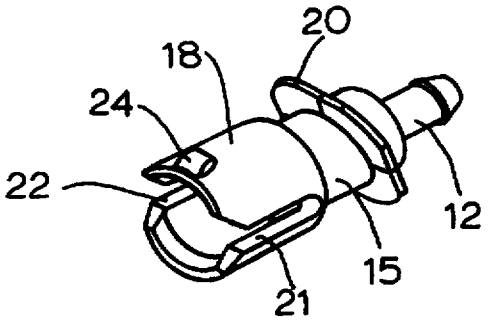
FIG. 2 is a perspective view of the valve body.
Figure 3:
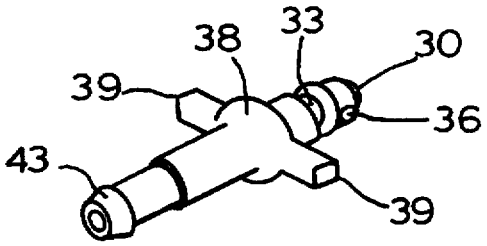
FIG. 3 is a perspective view of the valve piston.

The third tubular portion has two axially extending, diametrically opposed slots (21,22) see FIG. 2) which extend along the body from one end thereof. The third tubular portion (18) also has two diametrically opposite outwardly projecting protrusions (24,25) which are spaced by 90° from the slots (21,22).

The valve piston is generally tubular and closed at one end (30), which locates in the second tubular portion (15) of the body. The end (30) is chamfered at (31) so that an O-ring (32) can locate between the piston end (30) and the shoulder (16) to provide a seal therebetween. Axially inwardly from the end (30) the tubular piston has a circumferential groove (33) which receives a second O-ring (34). Between groove (33) and the end (30) the piston wall has two diametrically opposite throughbores (36). In the position shown in FIG. 1 the bores are effectively sealed by the O-rings (32,34).

The piston is also formed with an annular flange (38) which is located in the third tubular body portion (18) adjacent the shoulder (17). At the same axial position the body has two diametrically opposite pins (39) which project outwardly through the slots (21,22) formed in the body.

Figure 4:
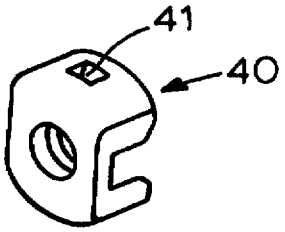
FIG. 4 is a perspective view of a valve spring holder.

The piston is biased towards the position shown in FIG. 1 by means of a spring (37) which is located around the piston between the flange (38) and a spring holder (40). The spring holder is shown in FIG. 4 and includes apertures (41) into which the projections (24,25) clip to retain the holder on the body (10). The end (42) of the piston which protrudes from the body (10) has a frustoconical end part (43) to receive another part of the shampoo conduit.

Figure 5:
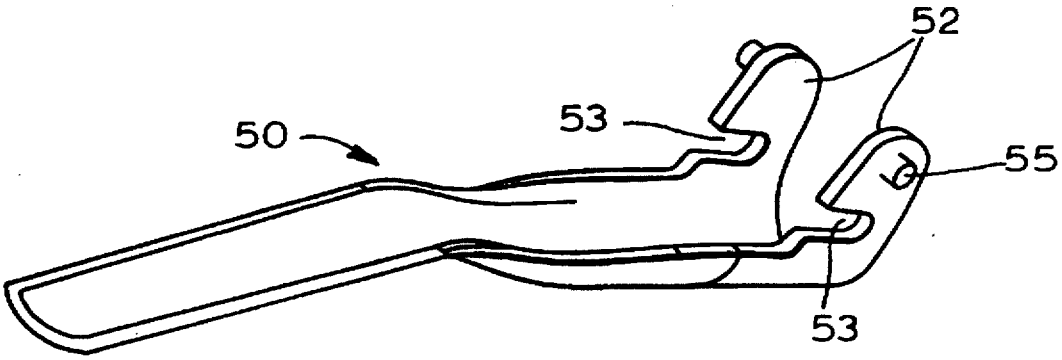
FIG. 5 is a perspective view of a lever for operating the valve.

The valve also includes an operating lever (50) shown in FIG. 5. The operating lever (50) includes a bifurcated part (52) which can straddle the valve body (10). Each limb of the bifurcation includes a slot (53) into which the end of each pin (39) can locate. Each limb of the bifurcation also includes outwardly projecting pins (55) which act as pivot points for the lever.

In operation the valve is usually in its position shown in FIG. 1 in which the piston is biased towards the right-hand side so theft the seals (32,34) effectively seal the throughbores (36). If the piston is moved axially to the left, as seen in FIG. 1, away from the seal (32) then fluid can flow along the interior of the piston, through the bore (36) and out through the body portion (12).

Figure 6:
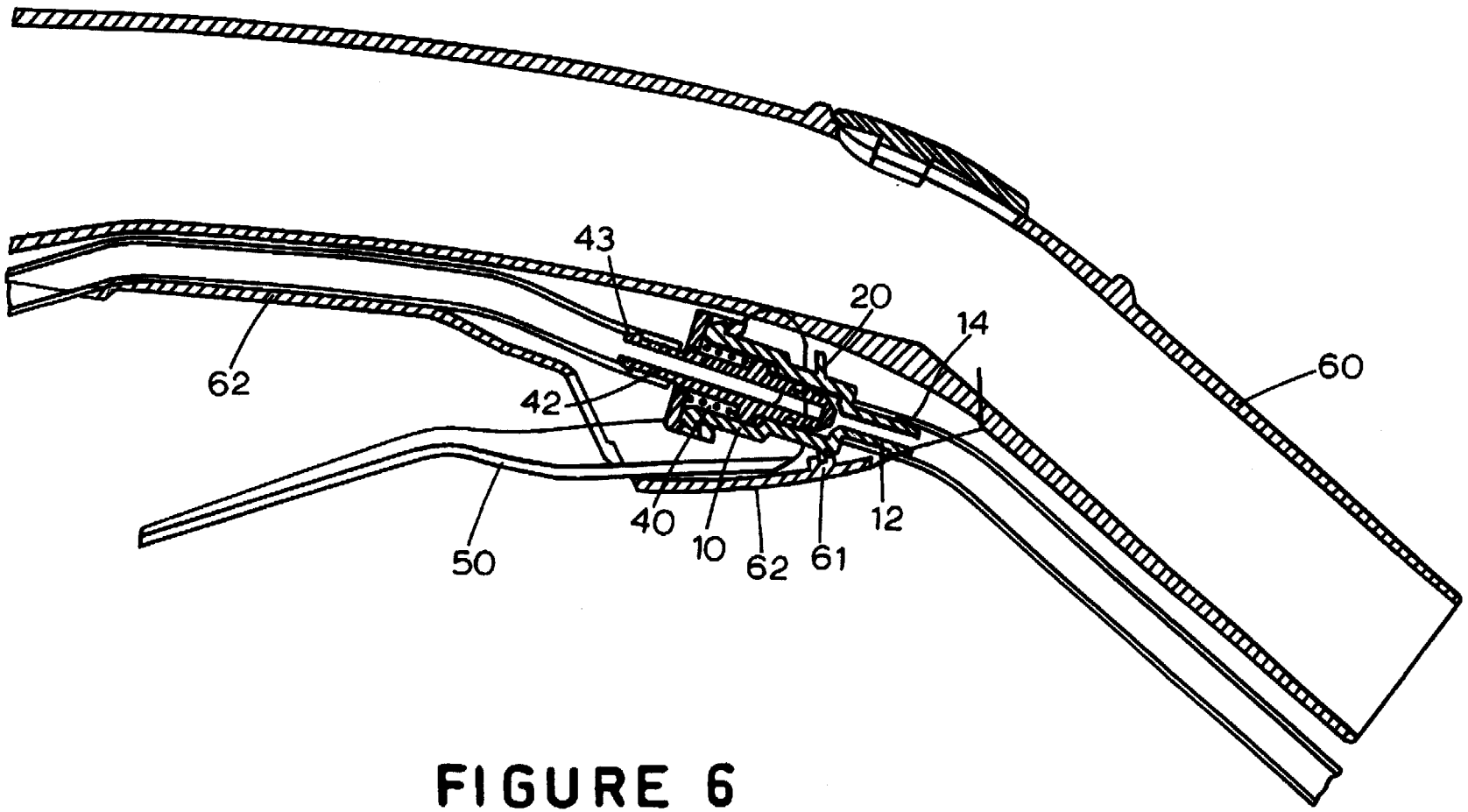
FIG. 6 is a view showing an assembly in accordance with the invention in a wet/dry vacuum cleaner.
Figure 7:
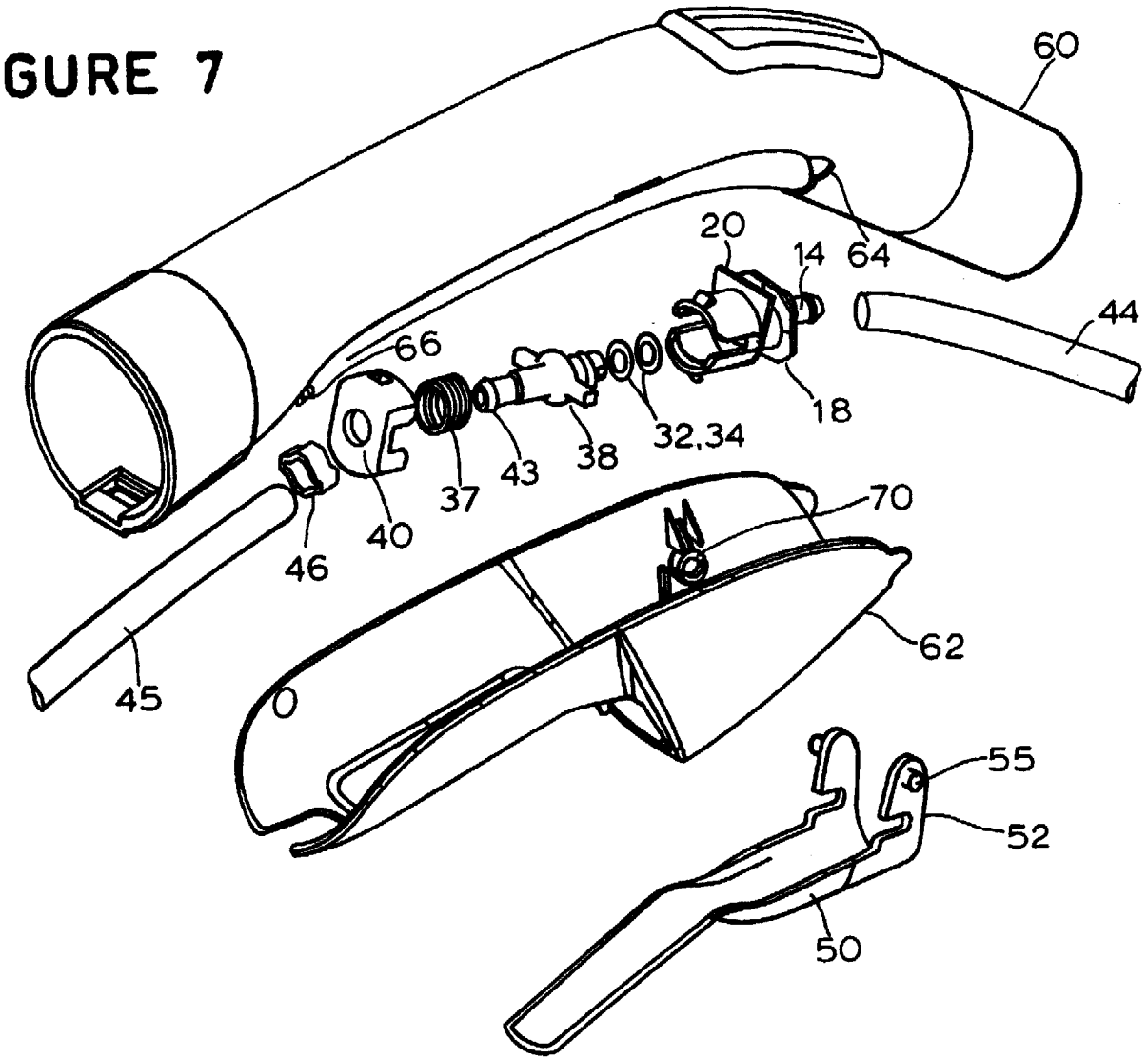
FIG. 7 is an exploded view of an assembly according to the invention.

Looking at FIG. 6 the valve is shown as part of a suction tube assembly of a wet/dry cleaner. The exploded view in FIG. 7 illustrates the constituent parts, with some minor differences of detail. In FIG. 6 the valve is in its operative position mounted beside a moulded suction tube (60) of the wet/dry vacuum cleaner. The flange (20) is used to locate and secure the valve body in the position shown in a groove (61) in a moulded housing (62, best seen in FIG. 7) which is a snap-fit with detents (64) and lugs (66) on the suction tube (60). The end portion (14) of the body is connected to one part (44) of a conduit for carrying shampoo and the end portion (43) of the piston is connected to another conduit part (45). A crimped ring (46, FIG. 7) ensures a secure connection of the piston end (43) and the conduit (45) which are subject to back and forth movement during operation of the valve.

The lever (50) is mounted so that it straddles the body and engages the pins (39) formed on the piston body. The pins (55) (not shown in FIG. 6) engage in recesses (70) formed in the housing (62) of the suction tube to allow the lever to pivot. When the lever is pivoted in a clockwise direction as viewed in FIG. 6 the valve member is moved axially away from the seat (32), as described with reference to FIG. 1 to thereby allow shampoo to flow along the conduit portions shown in FIG. 6. In this way a user of the machine can supply shampoo to the article being cleaned.

Advantages of the valve are its relative simplicity, the fact that it can be moulded from plastics material, and it is relatively inexpensive.

Advantages of the suction tube assembly as a whole are again low cost and simplicity, together with precise operation of the valve by means of the lever 50. The whole arrangement is of pleasing appearance and unlike some prior art devices has a positive and pleasing feel when operating the valve.

Each feature disclosed in this specification (which term includes the claims) and/or shown in the drawings may be incorporated in the invention Independently of other disclosed and/or illustrated features.

The appended abstract as filed herewith is included in the specification by reference.

I claim:

1. A suction tube assembly for a wet/dry cleaner comprising a suction tube, a fluid delivery conduit extending along the suction tube, a valve forming part of the conduit, and operating means for a user to operate the valve while manipulating the suction tube, the valve comprising a valve body having an opening at a forward end and having a tubular portion within which is located a valve piston having a generally tubular portion with a wall defining an interior cavity, said piston having a rearward end, said piston tubular portion having a closed forward end and having said fluid delivery conduit attached at said rearward end and movable with the fluid delivery conduit, the fluid delivery conduit supplying fluid to the cavity within the piston tubular portion, said piston tubular portion having a bore in said wall to provide communication between the interior cavity of the piston tubular portion and the interior of the tubular portion of the valve body, sealing means between the piston and the valve body; means biasing the piston forwardly towards a position in which the piston engages the sealing means to prevent flow of fluid out of the valve body through the opening therein, said piston and the attached fluid delivery conduit being movable axially by the operating means against said biasing means such that said piston disengages said sealing means, thereby allowing fluid to flow out of the valve body through the opening therein.

2. An assembly according to claim 1, wherein said piston has projections, and wherein the operating means is a lever which engages said projections on said piston.

3. An assembly according to claim 2, comprising a housing attached to the suction tube and encasing the valve and the lever, the valve body being located in the housing and the lever being pivotally mounted therein.

4. An assembly according to claim 1, wherein said tubular piston portion has an exterior, an exterior groove, wherein said tubular body portion has a shoulder, wherein said piston has an end part, and wherein the sealing means comprises first and second axially spaced O-rings, the first O-ring being located in the groove in the exterior of the tubular piston portion and the second O-ring being disposed between the shoulder on the tubular body portion and the forward end of the piston.

5. An assembly according to claim 4, wherein the operating means is a lever which engages projections on said piston.

6. An assembly according to claim 1, wherein the tubular valve piston portion has at least one bore.

7. An assembly according to claim 6, wherein said tubular piston portion has an exterior, an exterior groove, wherein said tubular body portion has a shoulder, wherein said piston has an end part, and wherein the sealing means comprises first and second axially spaced O-rings, the first O-ring being located in the groove in the exterior of the tubular piston portion and the second O-ring being disposed between the shoulder on the tubular body portion and forward the end of the piston.

8. An assembly according to claim 7, wherein said piston has projections, and wherein the operating means is a lever which engages said projections on said piston.

9. An assembly according to claim 6, wherein said piston has projections, and wherein the operating means is a lever which engages said projections on said piston.

10. An assembly according to claim 9, comprising a housing attached to the suction tube and encasing the valve and the lever, the valve body being located in the housing and the lever being pivotally mounted therein.

11. An assembly according to claim 1, wherein the biasing means comprises a spring.

12. An assembly according to claim 11, wherein said piston has projections, and wherein the operating means is a lever which engages said projections on said piston.

13. An assembly according to claim 12, wherein said tubular piston portion has an exterior, an exterior groove, wherein said tubular body portion has a shoulder, and wherein the sealing means comprises two axially spaced O-rings, the first O-ring being located in the groove in the exterior of the tubular piston portion and the second O-ring being disposed between the shoulder on the tubular body portion and the forward end of the piston.

14. An assembly according to claim 11, wherein the tubular valve piston portion has at least one bore.

15. An assembly according to claim 14, wherein said piston has projections, and wherein the operating means is a lever which engages said projections on said piston.

16. An assembly according to claim 15, comprising a housing attached to the suction tube and encasing the valve and the lever, the valve body being located in the housing and the lever being pivotally mounted therein.

17. An assembly according to claim 14, wherein said tubular piston portion has an exterior, an exterior groove, wherein said tubular body portion has a shoulder, and wherein the sealing means comprises two axially spaced O-rings, the first O-ring being located in the groove in the exterior of the tubular piston portion and the second O-ring being disposed between the shoulder on the tubular body portion and forward the end of the piston.

18. An assembly according to claim 17, wherein said piston has projections, and wherein the operating means is a lever which engages said projections on said piston.

19. A suction tube assembly for a wet/dry vacuum cleaner comprising a suction tube, a fluid delivery conduit extending alongside the tube, an in-line valve disposed in the conduit, the valve having a body portion and a tubular piston located within the valve body portion and defining an interior cavity, said piston having a rearward end, said piston being movable axially thereof to effect opening and closing of the valve, the fluid delivery conduit being attached axially to the rearward end of said piston and movable therewith for supplying fluid axially to the interior cavity thereof, means locating the valve body portion relative to the suction pipe, and valve operating means for axially moving the piston and the attached fluid conduit, the valve operating means being supported from the suction tube for a user to operate the valve while manipulating the suction tube.

20. An assembly according to claim 19, wherein said piston has projections, and wherein the operating means is a lever which engages said projections on said piston.

21. An assembly according to claim 20, comprising a housing attached to the suction tube and encasing the valve and the lever, the valve body being located in the housing and the lever being pivotally mounted therein.

22. An assembly according to claim 21, wherein the suction tube has a curved handle portion, and wherein the housing is attached beneath the curved handle portion of the suction tube.

23. An assembly according to claim 20, wherein the lever comprises a bifurcate portion which straddles the valve body.

24. An assembly according to claim 23, comprising a housing attached to the suction tube and encasing the valve and the lever, the valve body being located in the housing and the lever being pivotally mounted therein.

25. An assembly according to claim 24, wherein the suction tube has a curved handle portion, and wherein the housing is attached beneath the curved handle portion of the suction tube.

* * * * *